US007234318B2

(12) United States Patent
Grisler

(10) Patent No.: US 7,234,318 B2
(45) Date of Patent: Jun. 26, 2007

(54) OUTDOOR, MULTIPLE STAGE, SINGLE PASS AND NON-RECIRCULATING REFRIGERATION SYSTEM FOR RAPID COOLING OF ATHLETES, FIREFIGHTERS AND OTHERS

(76) Inventor: John K. Grisler, 11020 Cyrus River Ct., Rancho Cordova, CA (US) 95670

( * ) Notice: Subject to any disclaimer, the term of this patent is extended or adjusted under 35 U.S.C. 154(b) by 176 days.

(21) Appl. No.: 11/175,810

(22) Filed: Jul. 6, 2005

(65) Prior Publication Data

US 2006/0021374 A1 Feb. 2, 2006

Related U.S. Application Data

(60) Provisional application No. 60/586,255, filed on Jul. 8, 2004.

(51) Int. Cl.
*F25D 17/04* (2006.01)

(52) U.S. Cl. ..... 62/408

(58) Field of Classification Search ..... 62/93, 62/198, 199, 261, 304, 408, 259.4, 314, 414, 62/419

See application file for complete search history.

(56) References Cited

U.S. PATENT DOCUMENTS 4,658,596 A * 4/1987 Kuwahara ..... 62/197
5,168,713 A * 12/1992 Howland ..... 62/117
5,709,097 A * 1/1998 Kim et al. ..... 62/206
6,092,379 A * 7/2000 Nishida et al. ..... 62/200
6,385,985 B1 * 5/2002 Bussjager et al. ..... 62/259.1
6,490,877 B2 * 12/2002 Bash et al. ..... 62/200
6,519,955 B2 * 2/2003 Marsala ..... 62/119
6,672,082 B1 * 1/2004 Maeda et al. ..... 62/93
6,679,081 B2 * 1/2004 Marsala ..... 62/259.2
6,701,729 B2 * 3/2004 Bagley ..... 62/156
6,758,054 B2 * 7/2004 Zheng et al. ..... 62/199
6,772,600 B2 * 8/2004 Hwang, II ..... 62/160
6,938,430 B2 * 9/2005 Tanimoto et al. ..... 62/196.2

FOREIGN PATENT DOCUMENTS

JP 59-48220 A * 3/1984

* cited by examiner

*Primary Examiner*—Mohammad M. Ali
(74) *Attorney, Agent, or Firm*—Bruce H. Johnsonbaugh

(57) ABSTRACT

A multiple stage, single pass and non-recirculating refrigeration system is provided for either outdoor use or for use with temporary structures such as emergency firefighter tents. The refrigeration system utilizes, for example, three evaporative coils in series to achieve a 48° F. reduction of temperature and 70% reduction of humidity in a single pass, i.e., the output airstream from the refrigeration system is not recirculated to the blower as it is in the case of conventional air conditioning systems. The large amounts of super cool air provided by the invention can be used to cool athletes on the sidelines of a football field or firefighters who need to cool off to prevent heat stroke.

14 Claims, 12 Drawing Sheets

OUTDOOR, MULTIPLE STAGE, SINGLE PASS AND NON-RECIRCULATING REFRIGERATION SYSTEM FOR RAPID COOLING OF ATHLETES, FIREFIGHTERS AND OTHERS

CROSS-REFERENCE TO RELATED APPLICATION

This application claims the benefit of and priority from U.S. provisional application Ser. No. 60/586,255 filed on Jul. 8, 2004.

BACKGROUND AND BRIEF SUMMARY OF INVENTION

The present invention relates to refrigeration systems generally. More specifically, the invention provides a portable device that delivers a sufficient volume of refrigerated air to cool, for example, one or more football players either sitting or standing outside on the sideline of a football field. The invention is capable of delivering the dehumidified and cooled air outside, i.e., the athlete does not have to enter any enclosure to be cooled. The design specifically induces an envelope of cold air surrounding and engulfing a person in an environment of cold conditioned air at sufficient positive pressure, as to keep the surrounding ambient air from penetrating the adjacent 27 cu. ft. area directly in contact with the surface of the device, resulting in an entirely new atmosphere within the area of the device. The invention can cool 100° F., humid air in a single pass down to 52° F. and simultaneously dehumidify the air. The invention can also be used to cool other persons, for example, firefighters, large event patrons and consumers.

In one embodiment, a portable "refrigerated bench" is provided wherein 1 or 2 athletes or other persons simply sit on the device and cold, dry air is blown across their faces and bodies. Cold dry air is delivered in force and blown across their faces and bodies in such a configuration as to create a completely different pressure gradient whereas it overcomes the atmospheric pressure and creates the envelope and positive pressure zone. As another example of use, the invention can be used to cool firefighters in extreme conditions. Firefighters in one example enter a tent which is cooled by the invention. The ambient air may be 120° F.; the present invention, without recirculating air inside the tent, can introduce air into the tent at approximately 72° F. in a single pass. This can prevent heat stroke and allow the firefighters to return to the fire line quickly. Other embodiments are also described below.

The device can operate outside, or in an enclosed space, and cools and dries outdoor ambient air in a single pass; diffusing the positive pressure air into the unconfined surrounding pressure zone or into an enclosed space such as a tent.

The thing that makes the refrigerated bench and all of its related applications unique is its ability to operate in a single pass, without recirculating air, and to make cold 100% outside air. Normal air conditioning units, such as central air conditioning as in a home or automotive air conditioning, refrigerated food transport, and even portable air conditioning devices and machines, cannot do this. Normal existing air conditioning systems use a principle involving recirculated air, whereby they employ a single evaporative coil system to remove heat from the air. The existing air conditioning systems require that the air in an enclosed space be gradually cooled each time that it passes through the coil system. They employ the strategy of moving all of the air in the confined space through the coil multiple times, recirculating the air over and over and gradually removing heat from the recirculated air each time it passes through the evaporative coil system. Any air infiltration or air leakage in the enclosed space causes the existing systems to lose efficiency and causes the existing systems to operate that much longer and that much harder until the air temperature is met. They cannot possibly cool 100% outside air as they require confined air to be recirculated.

Each time the air is recirculated through existing coil systems, it is cooled approximately 18–22°. These types of systems require that the air be recirculated and confined in order to work. For extreme temperatures in climate zones exceeding 90–100° F. and with relative humidity above 50%, these systems could not possibly operate by using 100% outside air delivered to an unconfined space or to a non-insulated enclosure such as a firefighter's tent. The most that they could cool the air is 18–22° which, if the air is 100° outside, would only deliver around 80° output temperature and very little humidity removal would occur.

The present invention in its preferred form is a three stage refrigeration system which employs 3 evaporators in series with a single air stream, using 100% outside air and it can reduce the air temperature in one single pass by as much as 40–50° with approximately 60% to 75% moisture removal. The system can reduce the air temperature right now, in one pass causing an instant change from 100° air to 52° air, allowing the use of 100% outside air and making viable the design. The present invention is capable of operating in an unconfined, open space to cool and dehumidify hot air and produce a zone or region in which an athlete or other person may quickly cool down. The invention may also be adapted and converted to a heat pump configuration whereby the air may be warmed.

The prior art includes "swamp coolers" which simply add moisture to the air to reduce its temperature, as taught by U.S. Pat. No. 5,598,719 to Jones et al. The prior art also includes published U.S. patent application Ser. No. US 2002/0175541 to Floyd, which teaches the use of a conventional air conditioner as a separate device with duct work carrying cool air to a bench. Floyd does not teach or suggest the single pass, multiple stage evaporator technique of the present invention. Furthermore, the present invention combines the refrigeration mechanism with the air diffuser or dispenser into a single, portable unit usable where needed on sidelines, as opposed to the use of a separate refrigeration system connected to the bench by ducting.

Because of the present refrigeration design, athletes, firefighters and others may use the invention in any manner, standing, seated, lying down, etc. Its mechanical cooling and large temperature differential is what makes the design work. Its ability to deliver large temperature differential, air volume and velocity makes the possibility of an exposed exterior climate zone envelope of cool air possible.

The application of the preferred three stage, single pass embodiment of the invention can also be used for restaurants, where existing make up air devices employ the use of evaporative coolers to cool make up air. No longer do air conditioning systems have to overcome latent heat load due to evaporative coolers providing make up air. The present device can remove enough heat in one pass that the air delivered can be used as make up air itself.

The design can be used in many applications, i.e., automotive repair shops, air craft hangers, army training centers, amusement parks, warehouses and many, many applications yet undiscovered.

A primary object of the invention is to provide a multiple stage, non-recirculating and single pass refrigeration system capable of providing large amounts of super cool air to rapidly cool athletes, firefighters and others.

A further object of the invention is to provide a three stage, single pass and non-recirculating refrigeration system capable of immediately reducing 100° F. ambient air to a temperature of 52° F. and simultaneously removing 70% of the humidity.

Another object of the invention is to provide a multiple stage single pass and non-recirculating refrigeration system capable of use in a wide variety of situations where conventional recirculating refrigeration systems are incapable of achieving the desired result.

Other objects and advantages will become apparent from the following description and drawings:

DETAILED DESCRIPTION OF THE DRAWINGS

Figure 1:
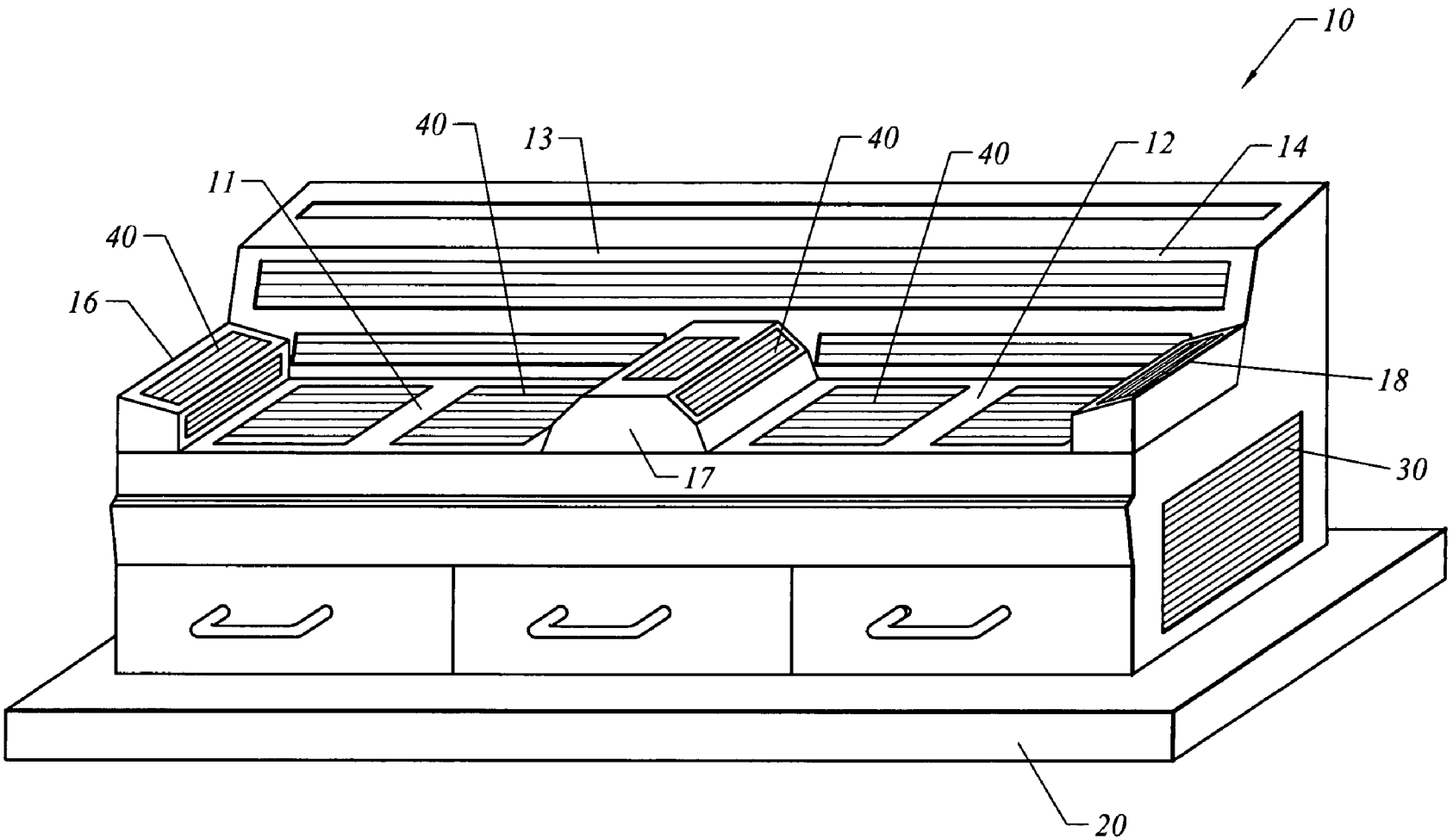
FIG. 1 is a perspective view of a refrigerated bench according to the present invention.

FIG. 1 is a front perspective view of a "refrigerated bench" 10 according to the present invention. Two seats 11 and 12 are provided, along with backrests 13 and 14, respectively. Three armrests 16, 17 and 18 are provided.

A base 20 supports bench 10. Base 20 is preferably mounted on wheels or casters (not shown) so that the bench 10 is portable and may be moved by an individual or towed by a small cart or automobile. The portable bench 10 shown in FIG. 1 is self-contained and weighs about 1,000 pounds; it has a 220 volt power cord adapted to utilize power readily available in most professional athletic stadiums.

Outside ambient air is drawn into intake 30, passes through the 3 stage cooling system described below and is discharged through cold air outlets or diffusers 40 in the seats, armrests and backrests.

Figure 2:
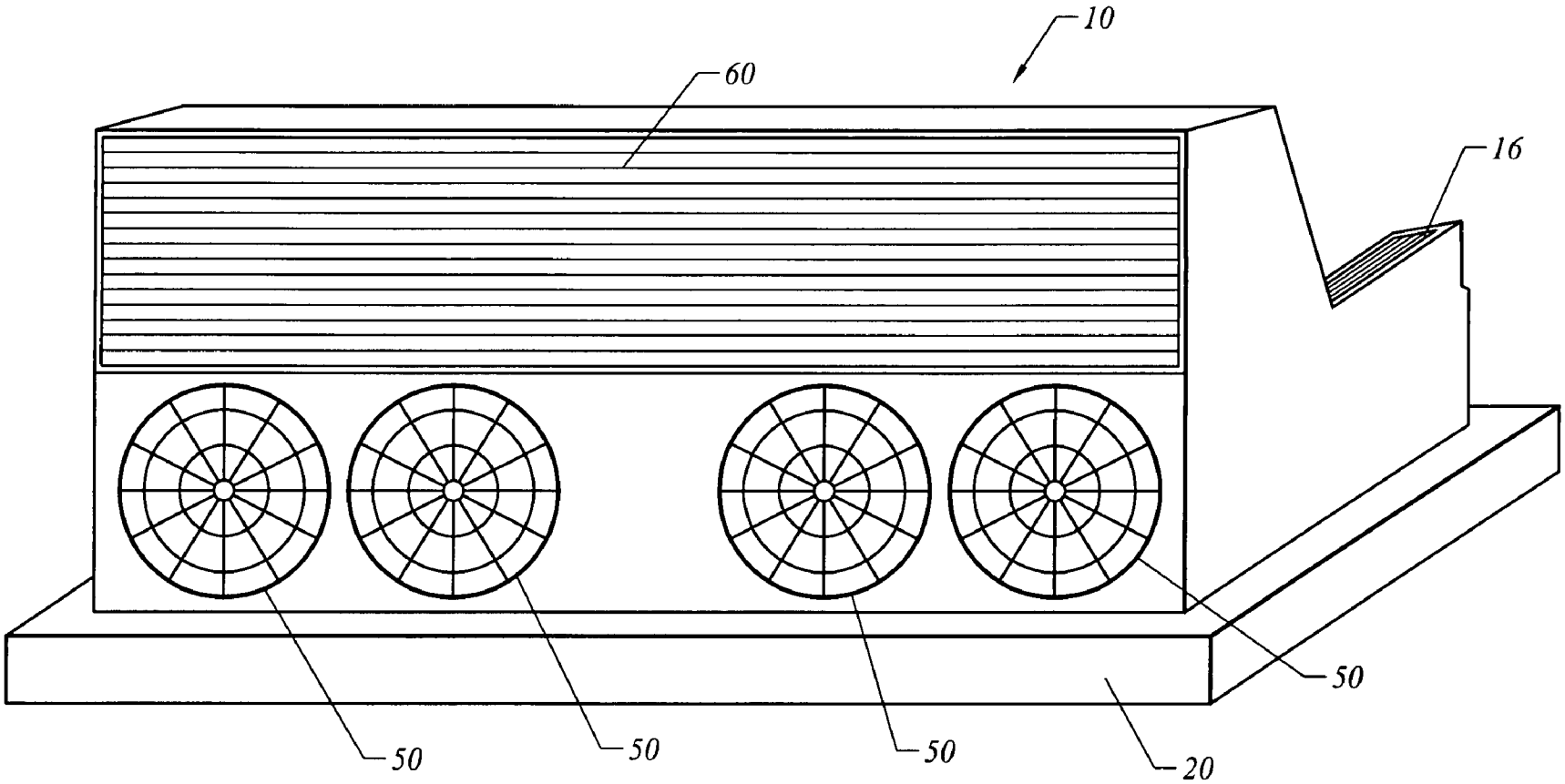
FIG. 2 is a rear perspective view of the refrigerated bench of FIG. 1.

FIG. 2 is a rear perspective view of the refrigerated bench 10 of FIG. 1. Fans 50 are utilized to cool refrigerant being pumped through condensing coils 60 by a compressor carried within bench 10 but not visible in FIGS. 1 or 2.

Figure 3:
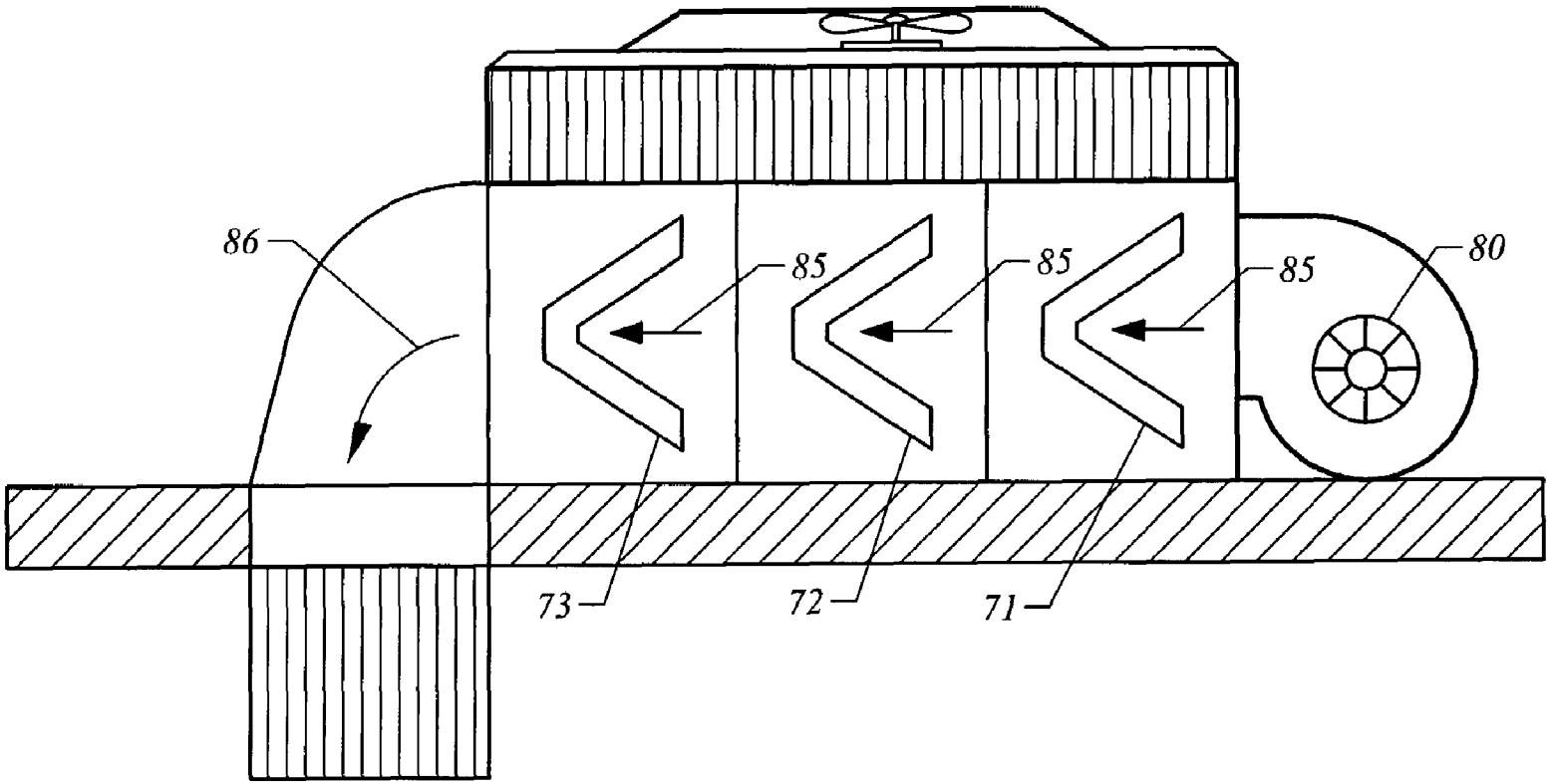
FIG. 3 is an elevational view showing the preferred three stage refrigeration system used in the bench shown in FIGS. 1 and 2.

FIG. 3 illustrates the preferred three stage, single pass series of evaporative coils 71, 72 and 73 along with fan 80. The coils 71–73 and fan 80 are positioned below seats 11 and 12 of bench 10, and are contained within the lower interior portion of bench 10. The coils 71–73 form a single pass, in series array of coils for a single airstream shown by arrows 85. The cold and dried air exits the coils as shown by arrow 86 and is discharged directly into a plenum formed by seats 11,12, backrests 13,14 and armrests 16–18 and through the outlets or diffusers mounted therein as shown in FIG. 1.

It is significant to note that multiple coils may be used in series and the number of coils in the general case is n where n is greater than 1. The use of three stages is preferred because each stage produces approximately a 16° F. temperature drop and approximately a 23% reduction of humidity; most end users of the invention would prefer a 45° to 50° temperature drop and about a 70% reduction of humidity. Other numbers of stages could be used for special end users.

Figure 4:
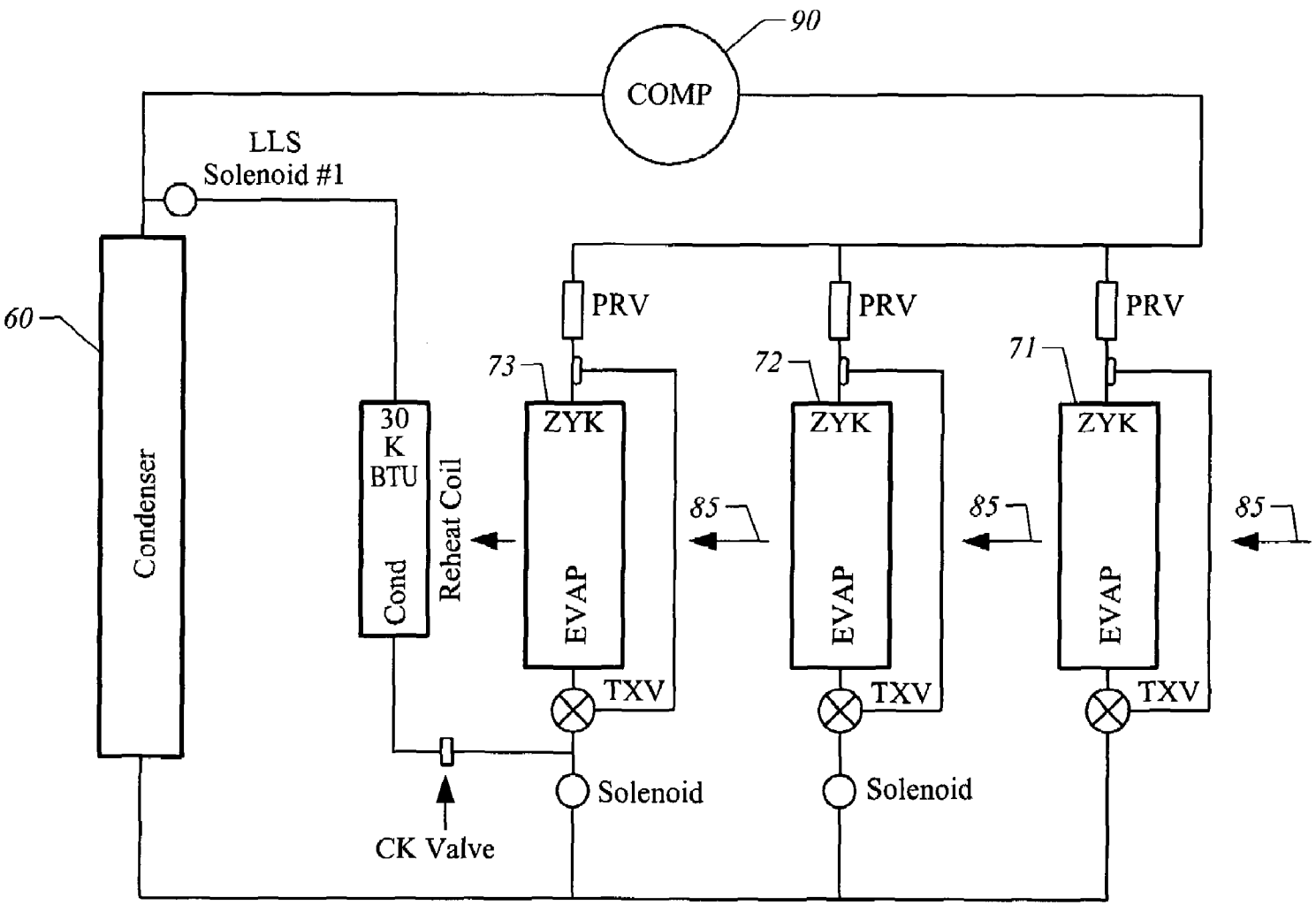
FIG. 4 is a schematic diagram of the refrigerant piping used in the refrigeration system shown in FIG. 3.

FIG. 4 is a schematic diagram of the refrigerant piping. The refrigerant is R-22 or other available refrigerants. Evaporative or cooling coils 71–73 are shown in series with a single airstream shown by arrows 85. A single compressor 90 and single condenser 60 condense and compress the refrigerant from all 3 evaporators 71–73.

The bench 10 can be reconfigured in a variety of ways pursuant to the invention. Elevated seating platforms may be provided above the diffusers 40 in seats 11,12. Footrests with diffusers may be added.

Figure 5:
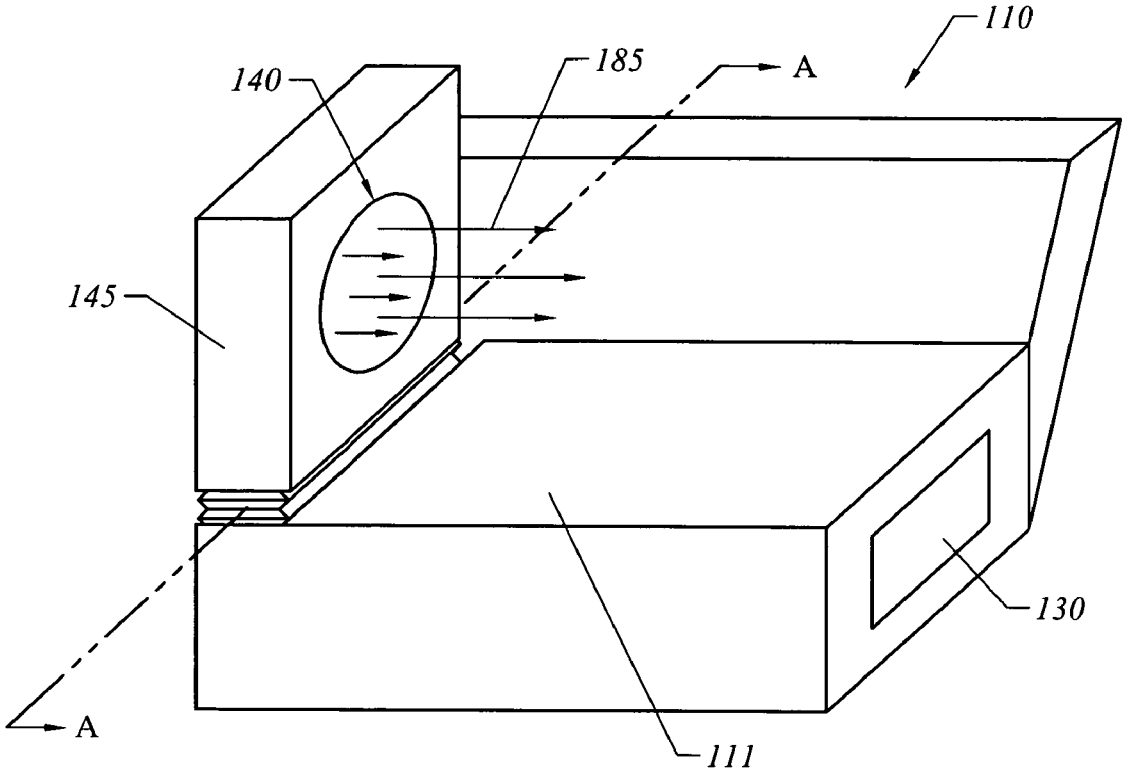
FIG. 5 illustrates an alternate embodiment of a refrigerated bench according to the invention.

Another bench 110 shown in FIG. 5 provides a single, large movable outlet 140 adjacent a seat 111. A single, massive airstream shown by arrows 185 is produced. Outlet 140 may be mounted in a movable cabinet 145 rotatable around axis A—A to adjust the massive airstream 185 as desired. Incoming air enters at inlet 130.

Figure 6:
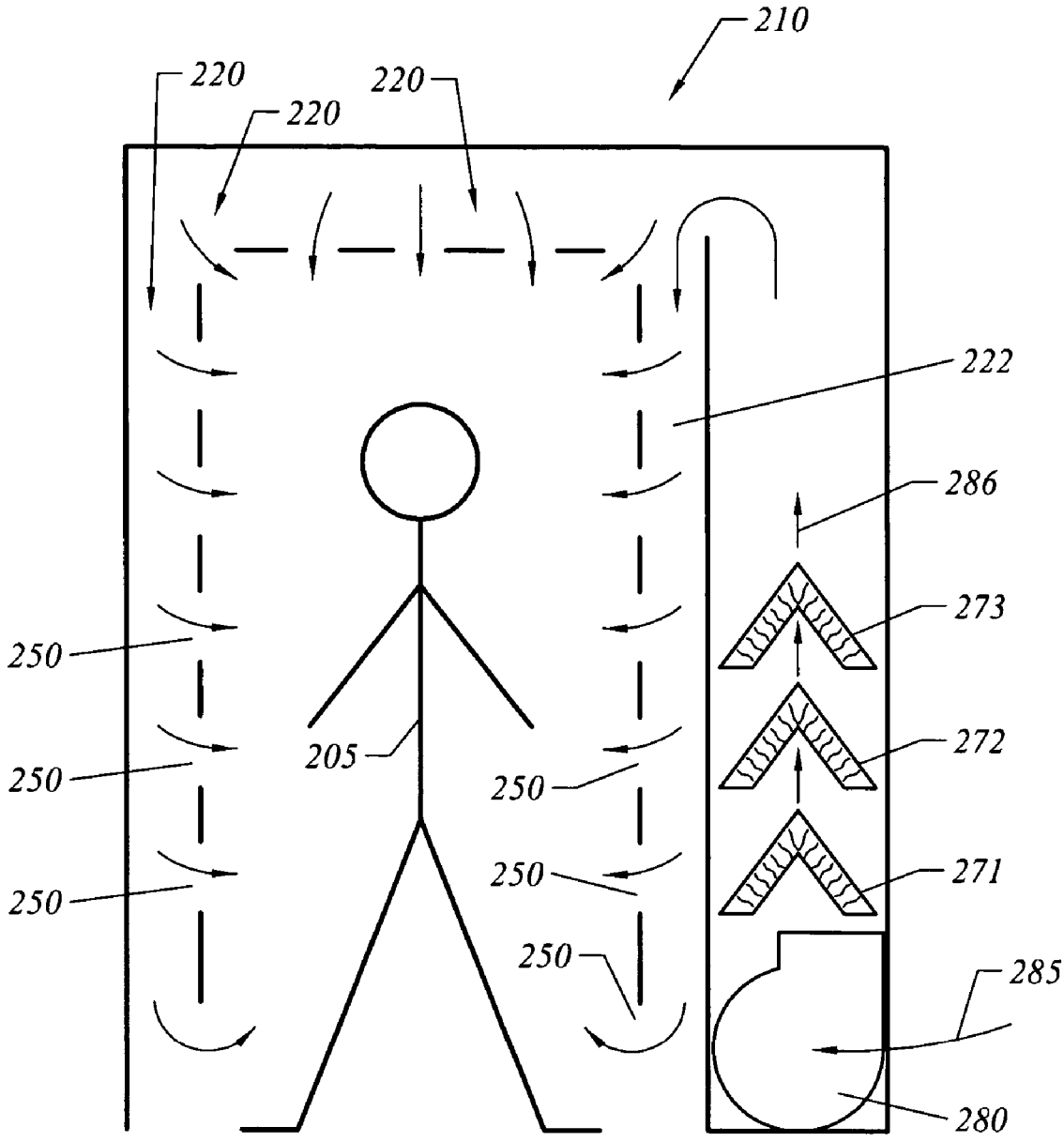
FIG. 6 illustrates a cold air shower embodiment of the invention.

FIG. 6 illustrates a "Cold Air Shower" embodiment of the invention, intended for use by firefighters, patrons of state fairs or other large, outdoor events. Patrons who are overheated or who simply want to enjoy a cold air shower simply step into the device and are quickly cooled.

The shower 210 includes a generally inverted U-shaped plenum 220 which forms a non-enclosed chamber, open in the front and back, and having side walls formed by plenum segments 221 and 222.

The three stage, single pass mechanical system, described above and shown in FIGS. 3 and 4, includes three evaporative coils 271, 272 and 273 positioned in series vertically. Coils 271–273 cool a single incoming stream of outside ambient air shown by arrow 285 and driven by fan 280. The cold air stream 286 flows upwardly into plenum 220 and through diffusers or openings 250 and across the entire body of the user 205. The compressor and condenser are connected to coils 271–273, as shown in FIGS. 3 and 4, and are not shown in FIG. 6 in the interest of clarity.

Figure 7A:
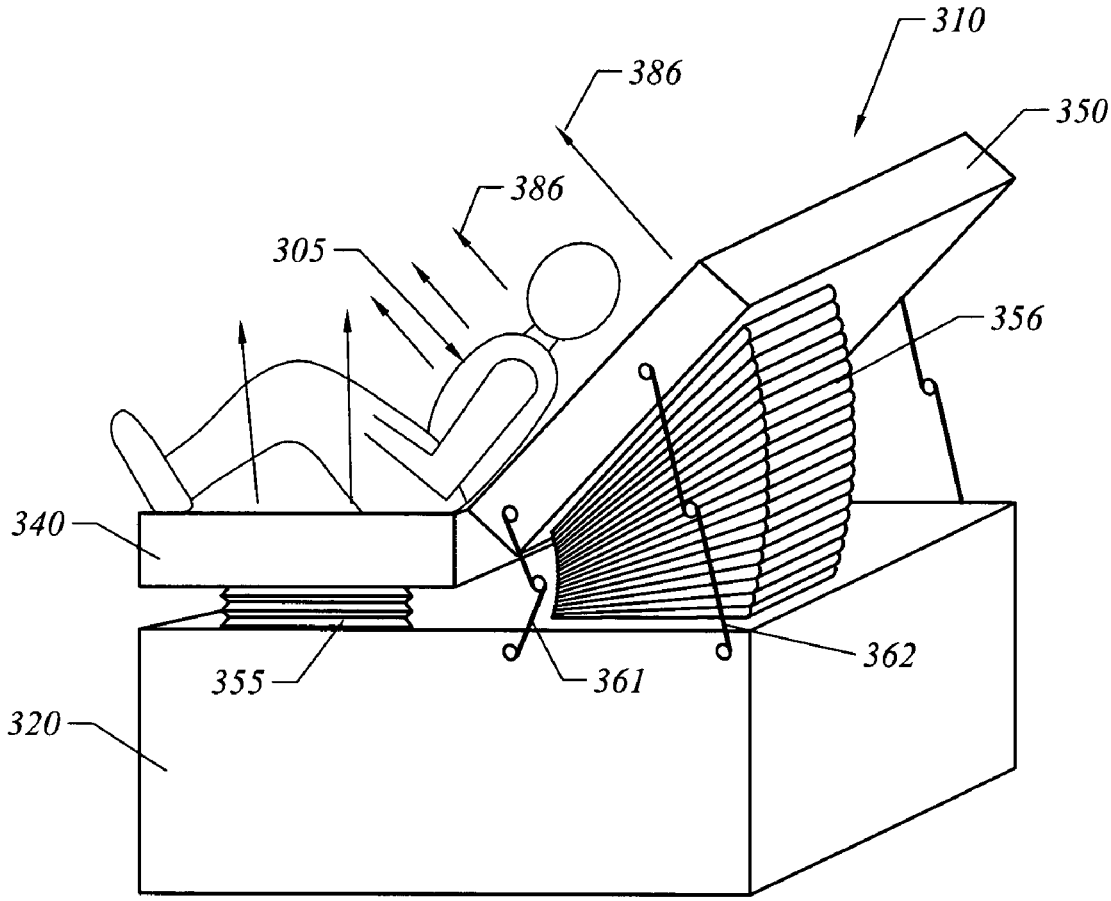
FIGS. 7A and 7B illustrate a "rejuvenator" embodiment of the invention shown in its open position in FIG. 7A and in its closed position in FIG. 7B.
Figure 7B:
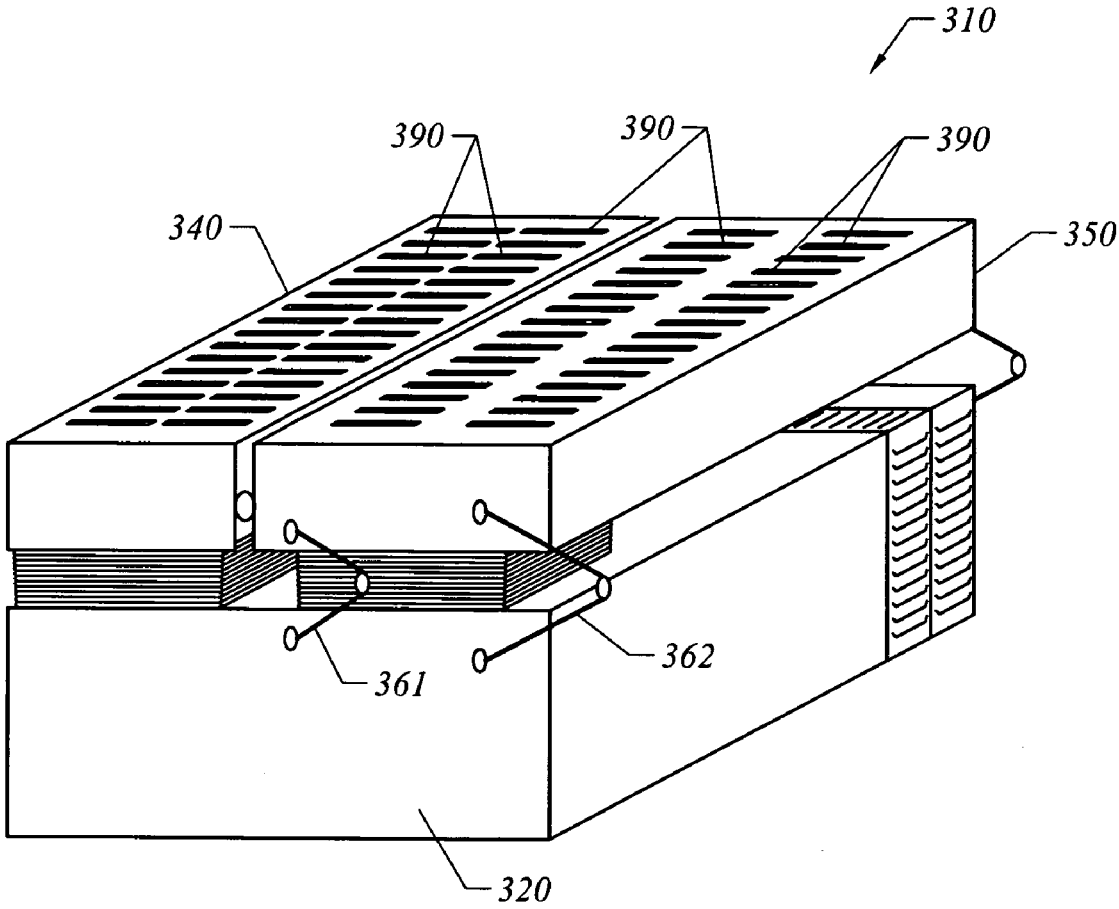

FIGS. 7A and 7B illustrate a "Rejuvenator" embodiment of the invention shown as 310. In its open position shown in FIG. 7A, a base 320 houses the three cooling coils, compressor and condenser (not shown in FIG. 7) in a fashion similar to that shown in FIGS. 3 and 4 and described above. A seat 340 and rotatable backrest 350 are mounted on base 320 and are connected to base 320 by flexible ducts 355 and 356. Openings or diffusers 390 (see FIG. 7B) in the upper surfaces of seat 340 and backrest 350 direct the cold, dry airstream 386 from the cooling coils (not shown) upwardly, as shown by arrows 386, and across the body of user 305.

Pivot arms 361 and 362 connect bench 320 with backrest 350. Pivot arms 361 and 362 support backrest 350 in its open position shown in FIG. 7A. Pivot arms 361 and 362 close, as shown in FIG. 7B, to allow backrest 350 to rotate to its closed position wherein it lies adjacent to and parallel to bench 320. Alternate support arms may be used in place of pivot arms 361 and 362.

Figure 8:
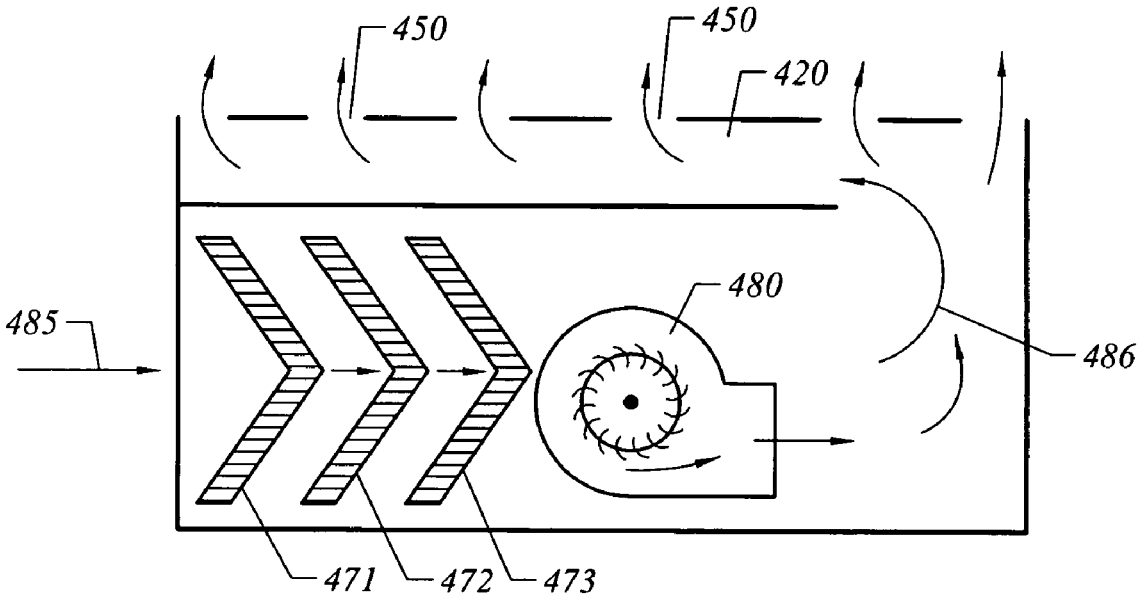
FIG. 8 illustrates an alternate configuration wherein the blower is located downstream of the 3-stage cooling coils used in the invention.

FIG. 8 illustrates an alternate configuration wherein blower or fan 480 draws incoming ambient air 485 through the three stage cooling coils 471, 472 and 473. The cooled and dried airstream 486 then enters plenum 420 and is directed to outlets or diffusers 450 as described above.

Figure 9:
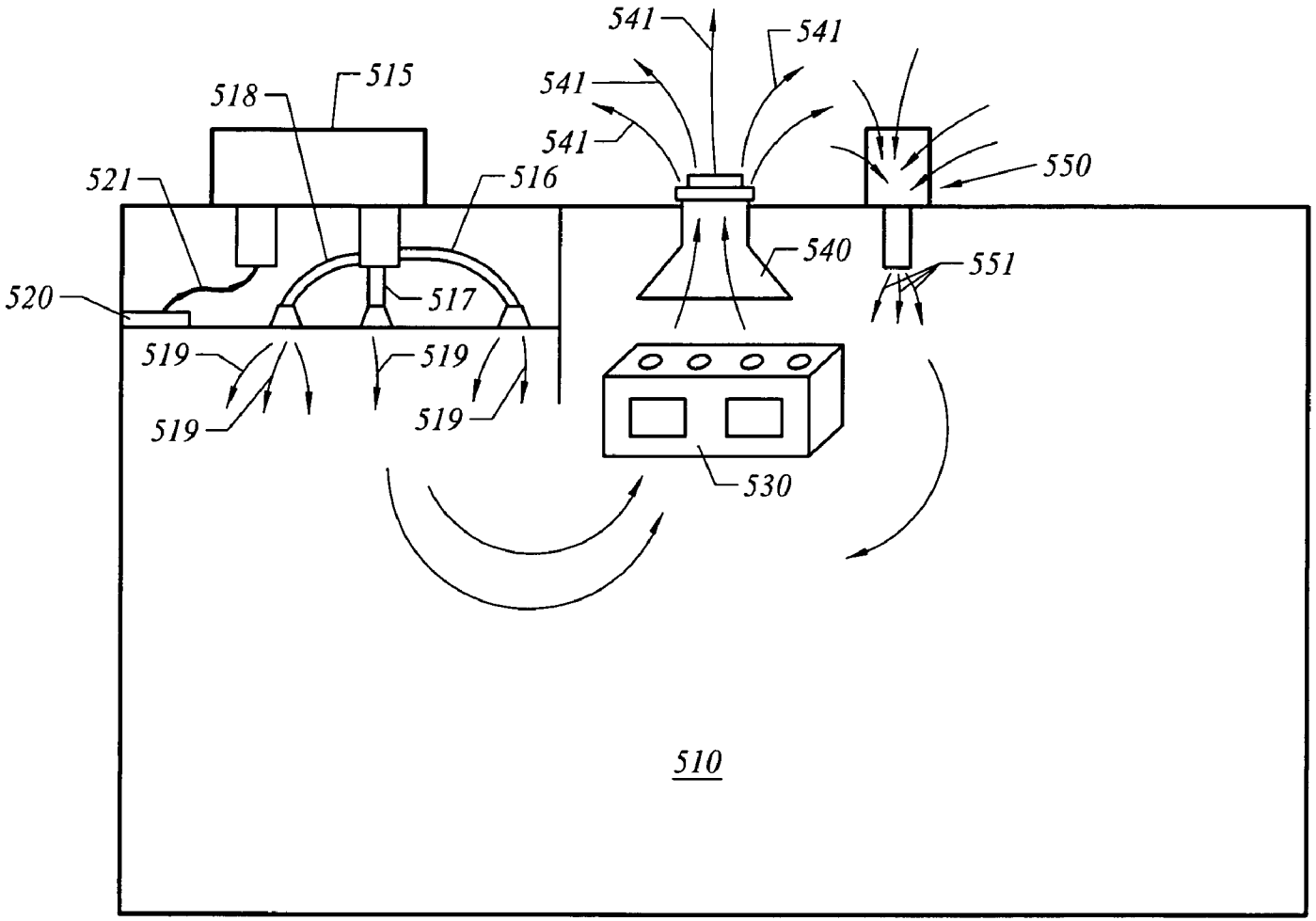
FIG. 9 (Prior Art)
FIG. 9 is a schematic illustration of a typical restaurant air conditioning and ventilating system of the prior art.

As noted above, the present invention may also be utilized in conjunction with restaurant "make-up" air systems. FIG. 9 is a schematic illustration of a typical restaurant air conditioning and ventilating system. The enclosed space of the restaurant is shown generally as 510. A commercially available air conditioning system is shown generally as 515 including ducts 516, 517 and 518 which deliver refrigerated air into interior space 510 as shown by arrows 519. Air is recirculated through the air conditioning unit 515 through a return air register 520 and return duct 521.

Massive amounts of heat are generated in the restaurant by its ovens and grills shown generally as 530. A relatively large exhaust fan 540 is provided to continually exhaust the hot air, smoke, and other airborne particles created by the cooking process and exhausts that air into the ambient atmosphere as shown by arrows 541. In order to replace the air pumped directly into the atmosphere by exhaust fan 540, the prior art provides "make-up" air by using an evaporative cooler 550, also known as a "swamp cooler." The "swamp cooler" 550 supplies "make-up" air by simply adding moisture to ambient air and pumping the moisture laden ambient air into the restaurant space 510 as shown by arrows 551. This "make-up" air shown by arrows 551 includes massive quantities of latent heat which must be removed by the conventional air conditioning system 515. The prior art uses "swamp coolers" because the "make-up" air is 100% outside air and no viable equipment is currently available which can refrigerate in a single pass the "make-up" air.

Figure 10:
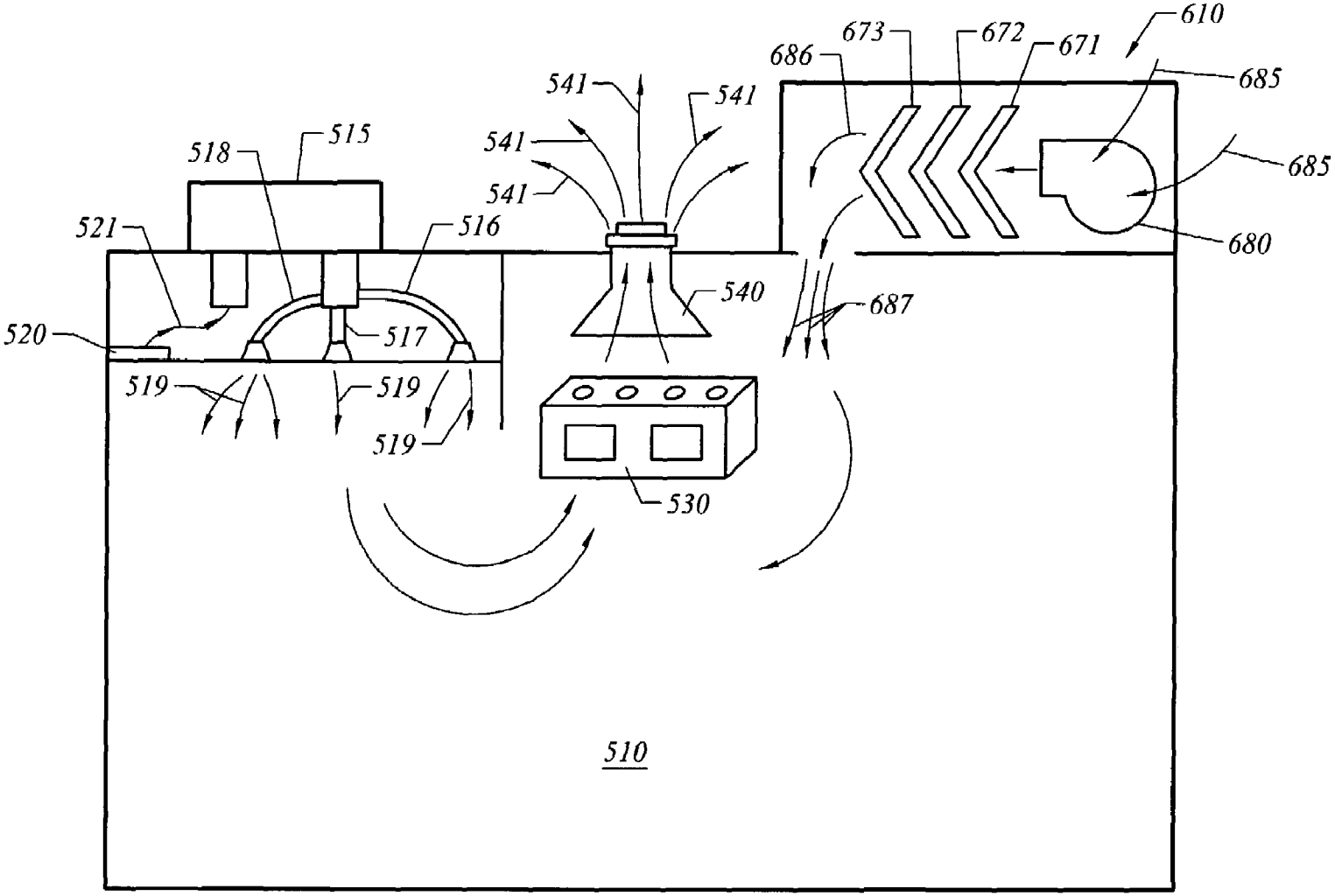
FIG. 10 is a schematic illustration of the same restaurant shown in FIG. 9 utilizing the present invention.

FIG. 10 is a schematic illustration of the same restaurant interior space 510 as shown in FIG. 9. However, in FIG. 10 the "swamp cooler" 510 has been replaced with the three stage, single pass refrigeration unit 610 of the present invention. A blower 680 pumps incoming ambient air 685 across evaporative coils 671, 672 and 673, creating cold dry air in a single flow stream shown as 686. This cool dry air is directed into the restaurant interior space 510 as shown by arrows 687. The use of the present invention to cool the "make-up" air substantially reduces the load carried by the prior art commercial air conditioning system 515.

Figure 11:
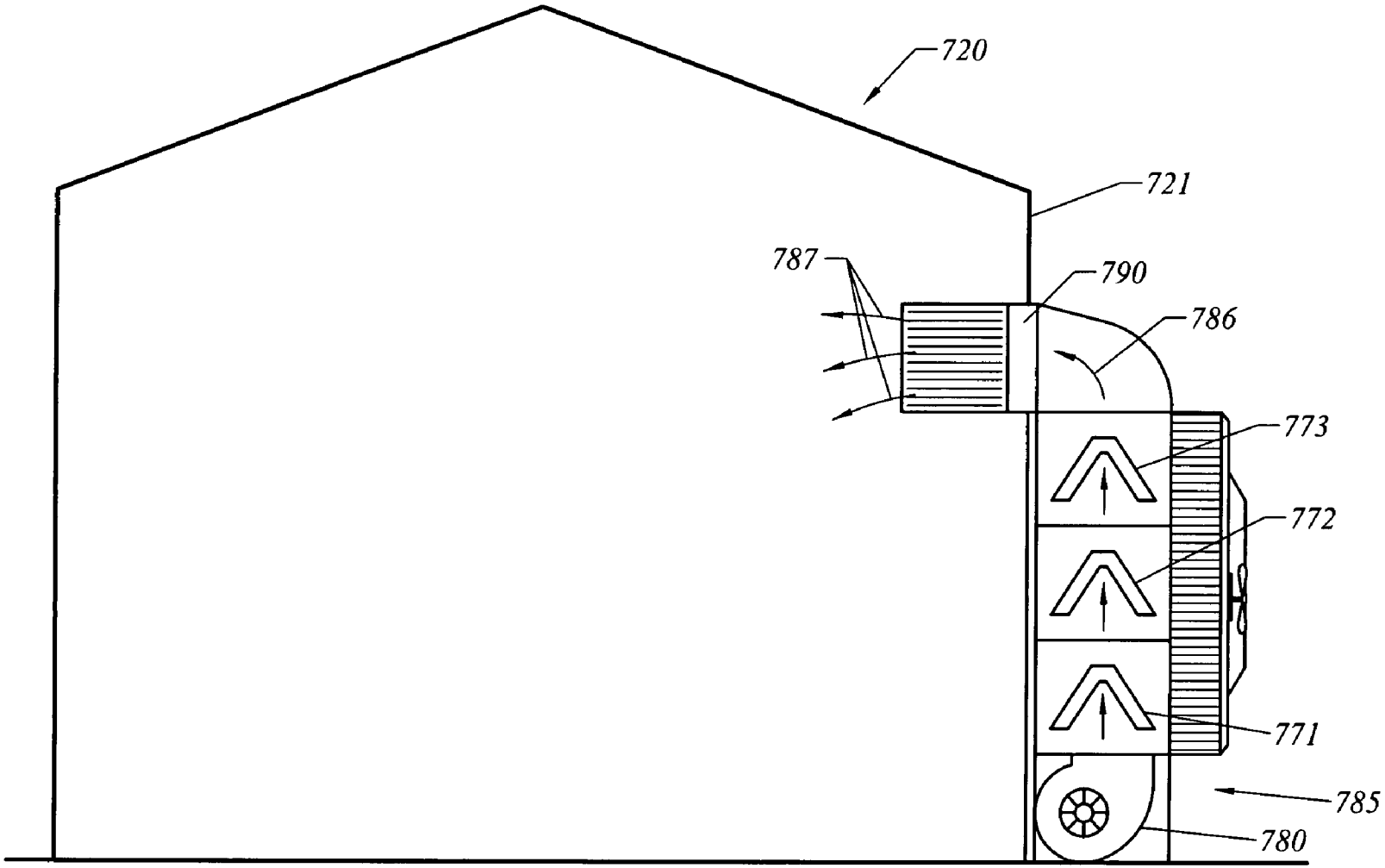
FIG. 11 is a schematic illustration of an alternate embodiment of the invention utilized by firefighters.

FIG. 11 is a schematic representation demonstrating the invention utilized to cool an emergency tent 720 utilized by fire fighters for example. The blower 780 and three evaporative coils 771, 772 and 773 are arranged vertically adjacent the side wall 721 of tent 720. The incoming airstream 785 is cooled by the three evaporative coils, as discussed above, and exits as a single massive cold and dehumidified airstream 786. The output airstream 786 flows through a single massive outlet 790 directly into the interior of tent 720 as shown by arrows 787. Depending on the size of tent 720, one or more refrigeration systems of the present invention may be utilized to provide adequate air flow for cooling the firefighters inside the tent. The refrigeration system of the present invention is easily transportable and can be deployed in a matter of minutes.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A three stage, single pass and non-recirculating refrigeration system, comprising:

first, second and third separate evaporative coils arranged in series with respect to a single airstream whereby said single airstream flows through said first coil, then through said second coil and then through said third coil, blower means for driving ambient air directly through said first, second and third evaporative coils in said single airstream, compressor means for compressing a refrigerant, condenser means for condensing said refrigerant, piping means for connecting said evaporative coils with said compressor means and condensing means, a refrigerant circulating through said compressor means, condenser means and said first, second and third evaporative coils, and output means for directing said airstream along a desired output airstream pathway after said airstream passes through said first, second and third coils, whereby said output airstream is 40° to 50° F. cooler and 60% to 75% drier than said ambient air and wherein said output airstream is not recirculated back into said blower means.

2. The apparatus of claim 1 further comprising an emergency tent used by firefighters, and wherein said output means comprises an outlet that directs said output airstream directly into said tent.

3. The apparatus of claim 1 further comprising a bench having seats and backrests forming a plenum into which said output airstream flows, and diffusers mounted in said seats and backrests.

4. The apparatus of claim 3 further comprising armrests forming part of said plenum, and at least one diffuser in said armrest.

5. The apparatus of claim 1 further comprising a flat, horizontal surface on which a person may sit or lie, said surface forming a part of a plenum into which said output airstream flows, and one or more diffusers carried by said horizontal surface.

6. The apparatus of claim 1 further comprising a generally inverted U-shaped plenum under which a person may stand, and multiple diffusers formed in said U-shaped plenum to form a cold air shower.

7. The apparatus of claim 1 used in combination with a restaurant central air conditioning system to supply refrigerated make-up air to said system.

8. A multiple stage, single pass and non-recirculating refrigeration system, comprising:

a plurality of three separate evaporative coils arranged in series with respect to a single airstream whereby said single airstream flows through said three coils, blower means for driving ambient air directly through said three evaporative coils in said single airstream, compressor means for compressing a refrigerant, condenser means for condensing said refrigerant, piping means for connecting said three evaporative coils with said compressor means and condensing means, a refrigerant circulating through said compressor means, condenser means and said three evaporative coils, and output means for directing said airstream along a desired output airstream pathway after said airstream passes through said three coils, and wherein said output airstream is not recirculated back into said blower means.

9. The apparatus of claim 8 further comprising an emergency tent used by firefighters, and wherein said output means comprises an outlet that directs said output airstream directly into said tent.

10. The apparatus of claim 8 further comprising a bench having seats and backrests forming a plenum into which said output airstream flows, and diffusers mounted in said seats and backrests.

11. The apparatus of claim 10 further comprising armrests forming part of said plenum, and at least one diffuser in said armrest.

12. The apparatus of claim 8 further comprising a flat, horizontal surface on which a person may sit or lie, said surface forming a part of a plenum into which said output airstream flows, and one or more diffusers carried by said horizontal surface.

13. The apparatus of claim 8 further comprising a generally inverted U-shaped plenum under which a person may stand, and multiple diffusers formed in said U-shaped plenum to form a cold air shower.

14. The apparatus of claim 8 used in combination with a restaurant central air conditioning system to supply refrigerated make-up air to said system.

* * * * *